US007286087B1

(12) United States Patent
Lee

(10) Patent No.: US 7,286,087 B1
(45) Date of Patent: Oct. 23, 2007

(54) DUAL-BAND INVERTED-F ANTENNA

(75) Inventor: Chang-Jung Lee, Taoyuan County (TW)

(73) Assignee: Arcadyan Technology Corporation, Hsinchu (TW)

( * ) Notice: Subject to any disclaimer, the term of this patent is extended or adjusted under 35 U.S.C. 154(b) by 0 days.

(21) Appl. No.: 11/593,107

(22) Filed: Nov. 6, 2006

(30) Foreign Application Priority Data

Apr. 7, 2006 (TW) ..... 95112306 A

(51) Int. Cl.
*H01Q 1/38* (2006.01)
*H01Q 9/38* (2006.01)
*H01Q 19/00* (2006.01)

(52) U.S. Cl. ..... 343/700 MS; 343/830; 343/833

(58) Field of Classification Search ..... 343/700 MS, 343/767, 830, 833
See application file for complete search history.

(56) References Cited

U.S. PATENT DOCUMENTS 7,136,025 B2 * 11/2006 Lin et al. ..... 343/770
2004/0263391 A1 * 12/2004 He et al. ..... 343/700 MS
2005/0259024 A1 * 11/2005 Hung et al. ..... 343/770

* cited by examiner

*Primary Examiner*—Shih-Chao Chen
(74) *Attorney, Agent, or Firm*—Birch, Stewart, Kolasch & Birch, LLP

(57) ABSTRACT

A dual-band inverted-F antenna includes a first radiating unit, a second radiating unit and a third radiating unit. The first radiating unit has a first long side and a first short side. The second radiating unit has a second long side and a second short side. The second long side is disposed opposite the first short side of the first radiating unit. The third radiating unit has a first radiating part, a second radiating part and a third radiating part. The second radiating part and the third radiating part are respectively extended from one side of the first radiating part. There is a gap between the third radiating unit and the first radiating unit.

19 Claims, 14 Drawing Sheets

E-Plane

Frequency : 2450 MHz

Peak Gain : -0.69dBi(@1°)

Average Gain : -3.36dBi

E-Plane

Frequency : 4900 MHz

Peak Gain : 2.95dBi (@124°)

Average Gain : -2.41dBi

E-Plane

Frequency : 5250 MHz

Peak Gain : 1.33dBi (@125°)

Average Gain : -4.48dBi

E-Plane

Frequency : 5850 MHz

Peak Gain : 1.64dBi (@40°)

Average Gain : -2.44dBi

E-Plane

Frequency : 2450 MHz

Peak Gain : 0.17dBi (@152°)

Average Gain : -3.62dBi

E-Plane

Frequency : 4900 MHz

Peak Gain : 1.76dBi (@342°)

Average Gain : -3.00dBi

E-Plane

Frequency : 5250 MHz

Peak Gain : 1.77dBi (@327°)

Average Gain : -3.51dBi

E-Plane

Frequency : 5850 MHz

Peak Gain : 0.28dBi (@213°)

Average Gain : -4.69dBi

H-Plane

Frequency : 2450 MHz

Peak Gain : -3.01dBi(@28°)

Average Gain : -3.78dBi

H-Plane

Frequency : 5250 MHz

Peak Gain : -1.15dBi(@260°)

Average Gain : -3.38dBi

H-Plane

Frequency : 5850 MHz

Peak Gain : 0.31dBi (@275°)

Average Gain : -3.93dBi

DUAL-BAND INVERTED-F ANTENNA

BACKGROUND OF THE INVENTION

1. Field of Invention

The invention relates to an antenna and, in particular, to a dual-band inverted-F antenna.

2. Related Art

The rapidly developed radio transmission has brought various products and technologies applied in the field of multi-band transmission, such that many new products have the performance of radio transmission to meet the consumer's requirement. The antenna is an important element for transmitting and receiving electromagnetic wave energy in the radio transmission system. If the antenna is lost, the radio transmission system cannot transmit and receive data. Thus, the antenna plays an indispensable role in the radio transmission system.

Selecting a proper antenna can match the feature of the product, enhance the transmission property, and further reduce the product cost. Different methods and different materials for manufacturing the antennas are used in different application products. In addition, considerations have to be taken when the antenna is designed according to different frequency bands used in different countries.

As shown in FIG. 1, a conventional antenna 1 has a first radiating unit 11 and a second radiating unit 12. The first radiating unit 11 has a long side 111 and a short side 112. The second radiating unit 12 has a first radiating part 121, a second radiating part 122, and a third radiating part 123. The second radiating part 122 and the third radiating part 123 are respectively extended from one side of the first radiating part 121. There is a gap 13 between the first radiating part 121 and the first radiating unit 11.

Generally speaking, the operating band of the antenna 1 ranges from 5.15 GHz to 5.25 GHz. With the technical advances, the band defined by IEEE 802.11a ranges between 4.9 GHz and 5.85 GHz. It is seen that the antenna 1 cannot satisfy current needs. Moreover, most modern antennas have the functions of dual or multiple operating bands to enhance their performance and applications.

Therefore, it is an important subject of the invention to provide an antenna with a larger operating bandwidth suitable for modern needs and having dual bands.

SUMMARY OF THE INVENTION

In view of the foregoing, the invention is to provide a dual-band inverted-F antenna that satisfies modern bandwidth requirement and has two operating bands.

To achieve the above, the invention discloses a dual-band inverted-F antenna including a first radiating unit, a second radiating unit, and a third radiating unit. The first radiating unit has a first long side and a first short side. The second radiating unit has a second long side and a second short side. The second long side is disposed opposite the first short side of the first radiating unit. The third radiating unit has a first radiating part, a second radiating part and a third radiating part. The second radiating part and the third radiating part are respectively extended from one side of the first radiating part. There is a gap between the third radiating unit and the first radiating unit.

As mentioned above, according to the disclosed dual-band inverted-F antenna, the first radiating unit and the second radiating unit operate in the first band. The third radiating unit operates in the second band. The first band and the second band are compliant respectively with the IEEE 802.11b/g and IEEE 802.11a standards. Therefore, the dual-band inverted-F antenna of the invention can satisfy the modern bandwidth requirements and have two operating bands.

BRIEF DESCRIPTION OF THE DRAWINGS

The invention will become more fully understood from the detailed description given herein below illustration only, and thus is not limitative of the present invention, and wherein:

FIG. 10 is the E-plane radiation field of the vertically disposed dual-band inverted-F antenna operating at 5.85 GHz;

DETAILED DESCRIPTION OF THE INVENTION

The present invention will be apparent from the following detailed description, which proceeds with reference to the accompanying drawings, wherein the same references relate to the same elements.

Figure 1:
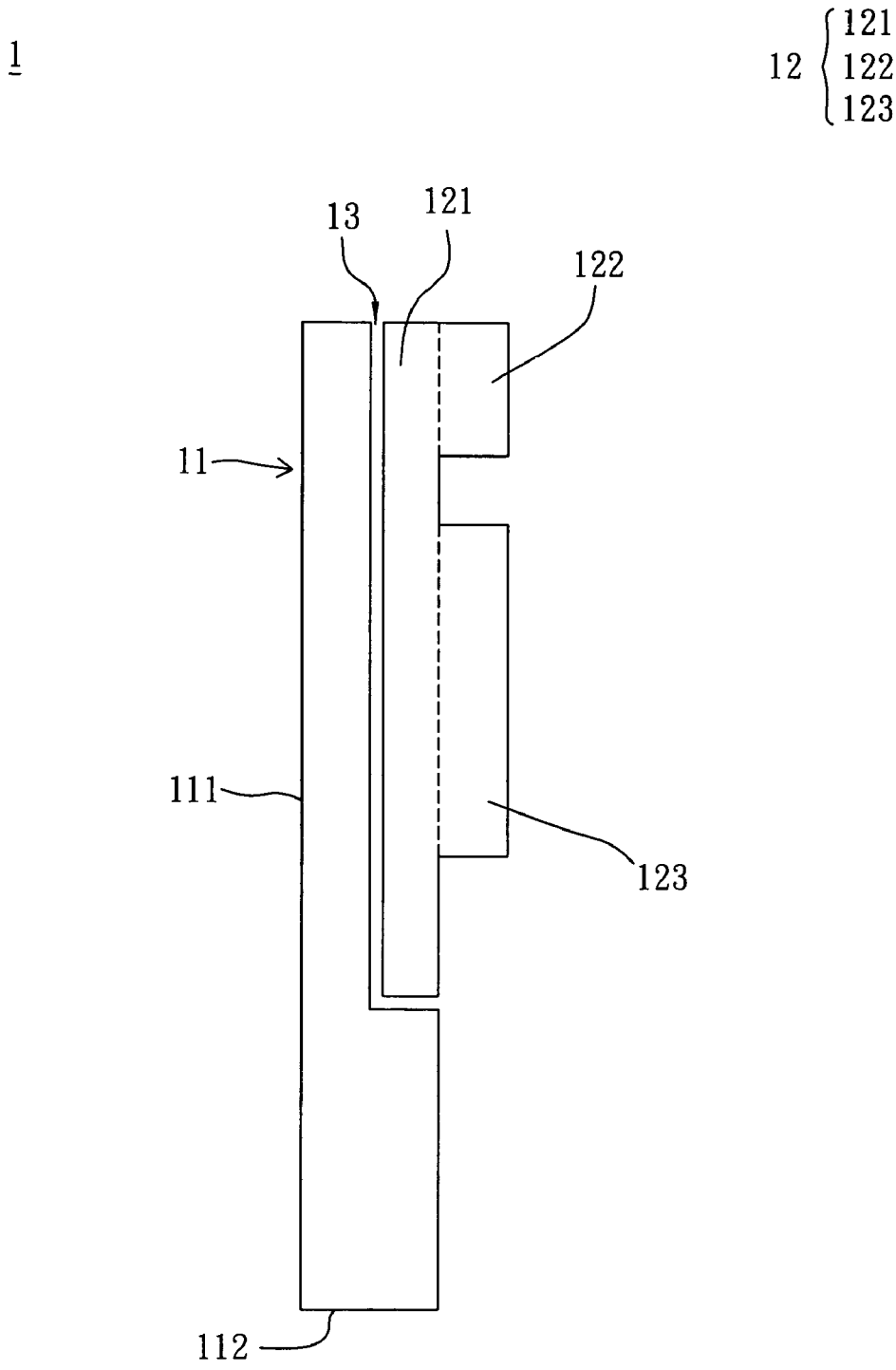
FIG. 1 (PRIOR ART)
FIG. 1 is a schematic view of a conventional antenna.
Figure 2:
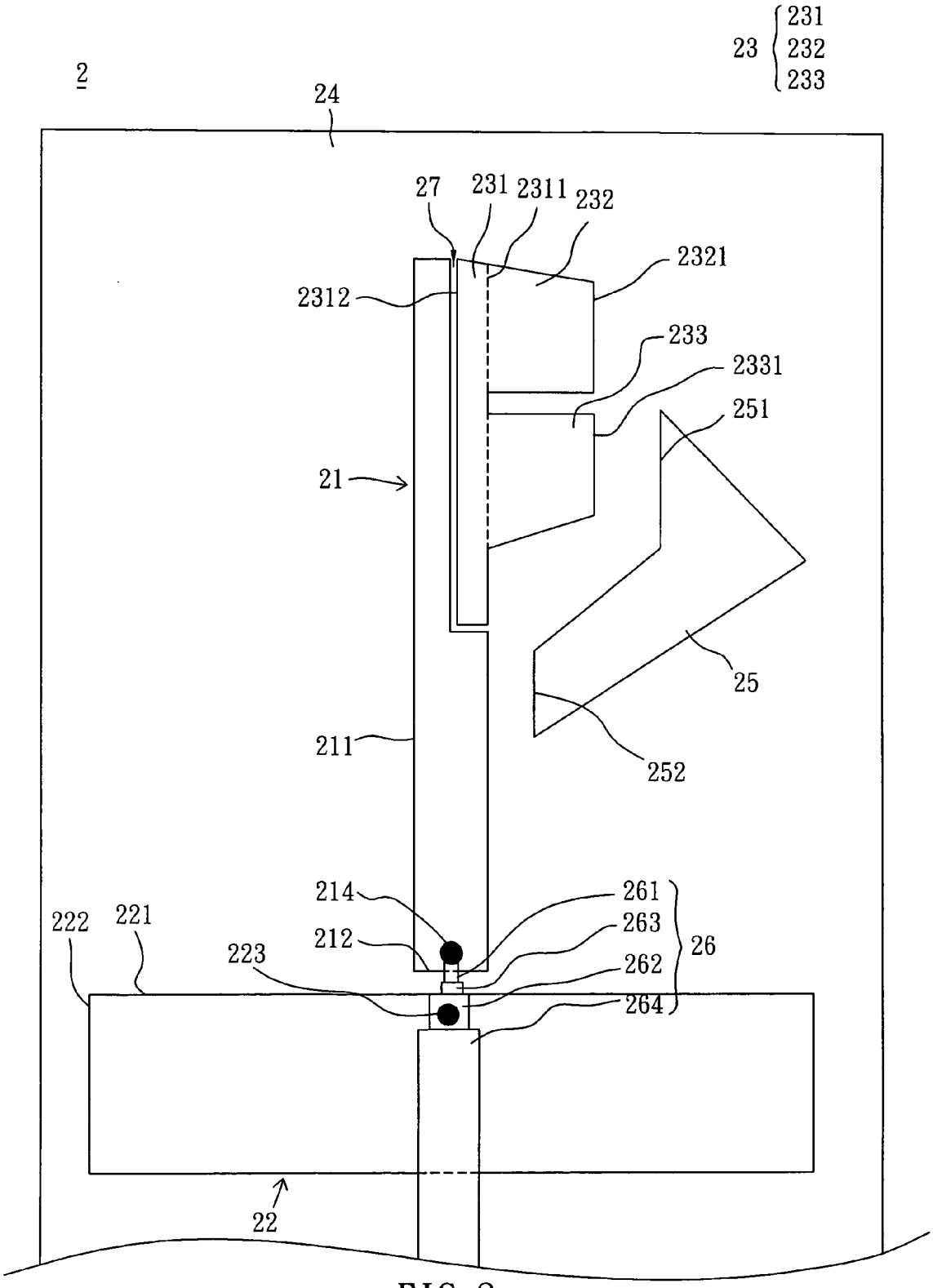
FIG. 2 is a schematic view of a dual-band inverted-F antenna according to a preferred embodiment of the invention.

As shown in FIG. 2, a dual-band inverted-F antenna 2 according to a preferred embodiment of the invention includes a first radiating unit 21, a second radiating unit 22, and a third radiating unit 23. The first radiating unit 21 has a first long side 211 and a first short side 212. The second radiating unit 22 has a second long side 221 and a second short side 222. The second long side 221 is disposed opposite to the first short side 212 of the first radiating unit 21. In this embodiment, the first radiating unit 21 and the second radiating unit 22 have respectively a feed-in point 214 and a ground point 223. The feed-in point 214 and the ground point 223 are disposed opposite to each other. Of course, the locations of the feed-in point 214 and the ground point 223 can be designed to be at different places according to practical needs.

The third radiating unit 23 has a first radiating part 231, a second radiating part 232, and a third radiating part 233. The first radiating part 231, the second radiating part 232, and the third radiating part 233 are quadrangles. The second radiating part 232 and the third radiating part 233 are extended respectively from one side of the first radiating part 231. There is a gap 27 between the third radiating unit 23 and the first radiating unit 21. In this embodiment, the gap 27 has an L shape, formed between the first radiating part 231 of the third radiating unit 23 and the first radiating unit 21. Besides, the first radiating part 231, the second radiating part 232, and the third radiating part 233 are trapezoids. The lower bases of the second radiating part 232 and the third radiating part 233 are parts of the upper base 2311 of the first radiating part 231. The second radiating part 232 and the third radiating part 233 are extended from the upper base 2311 of the first radiating part 231.

The first radiating unit 21 and the second radiating unit 22 operate in a first band. In this embodiment, the first band, between 2.4 GHz and 2.5 GHz, is compliant with the IEEE 802.11b/g standard. The length of the first long side 211 of the first radiating unit 21 and the length of the second long side 221 of the second radiating unit 22 are roughly equal to one quarter of the wavelengths in the first band.

The third radiating unit 23 operates in a second band. In this embodiment, the second band, between 4.5 GHz and 5.85 GHz, is compliant with the IEEE 802.11a standard. The sum of the length of the upper base 2321 of the second radiating part 232 and the length of the upper base 2331 of the third radiating part 233 is greater than one third of the length of the lower base 2312 of the first radiating part 231. The length of the upper base 2321 of the second radiating part 232 is greater than the length of the upper base 2331 of the third radiating part 233. Besides, the length of the lower base 2312 of the first radiating part 231 is roughly one quarter of the wavelengths in the second band.

Moreover, the dual-band inverted-F antenna 2 further includes an impedance matching unit 25 for increasing the bandwidth of the operating band. In this embodiment, the impedance matching unit 25 is a polygon, with one side 251 disposed opposite to the third radiating unit 23 and another side 252 disposed opposite to the first radiating unit 21. Since the impedance matching unit 25 can be designed to have different shapes according to practical needs, the invention does not have any restriction on its shape.

In this embodiment, the dual-band inverted-F antenna 2 further includes a substrate 24, which can be a printed circuit board (PCB). The first radiating unit 21, the second radiating unit 22, the third radiating unit 23, and the impedance matching unit 25 are disposed on the substrate 24. Besides, the dual-band inverted-F antenna 2 also includes a conducting unit 26 having a conductor 261 in electrical contact with the feed-in point 214 and a ground conductor 262 in electrical contact with the ground point 223. Moreover, the conducting unit 26 has a first insulating layer 263 and a second insulating layer 264. The first insulating layer 263 is disposed between the conductor 261 and the ground conductor 262 for insulation. The second insulating layer 264 is disposed on the outermost layer of the conducting unit 26 for insulation and protection. In this embodiment, the conducting unit 26 is a coaxial cable.

Figure 3:
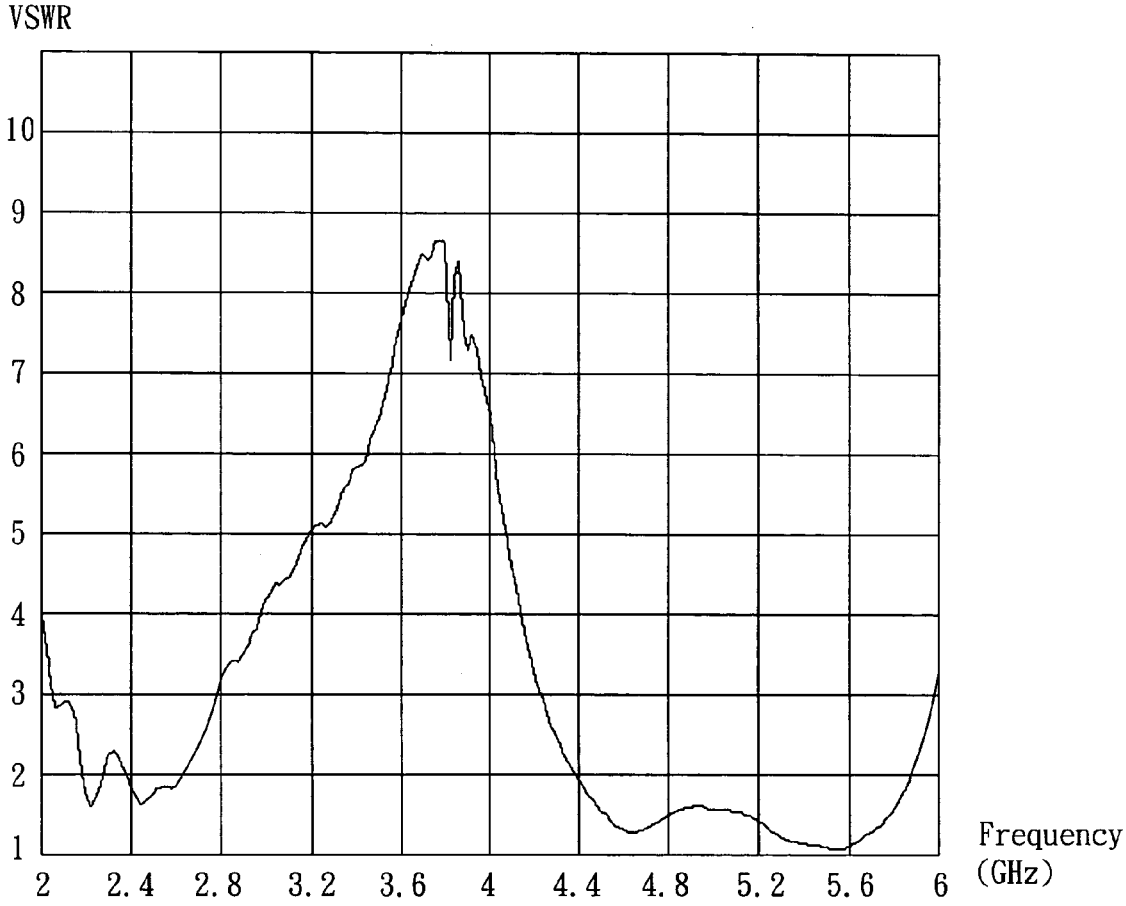
FIG. 3 shows a measurement of the operating band of the dual-band inverted-F antenna according to a preferred embodiment of the invention.
Figure 4:
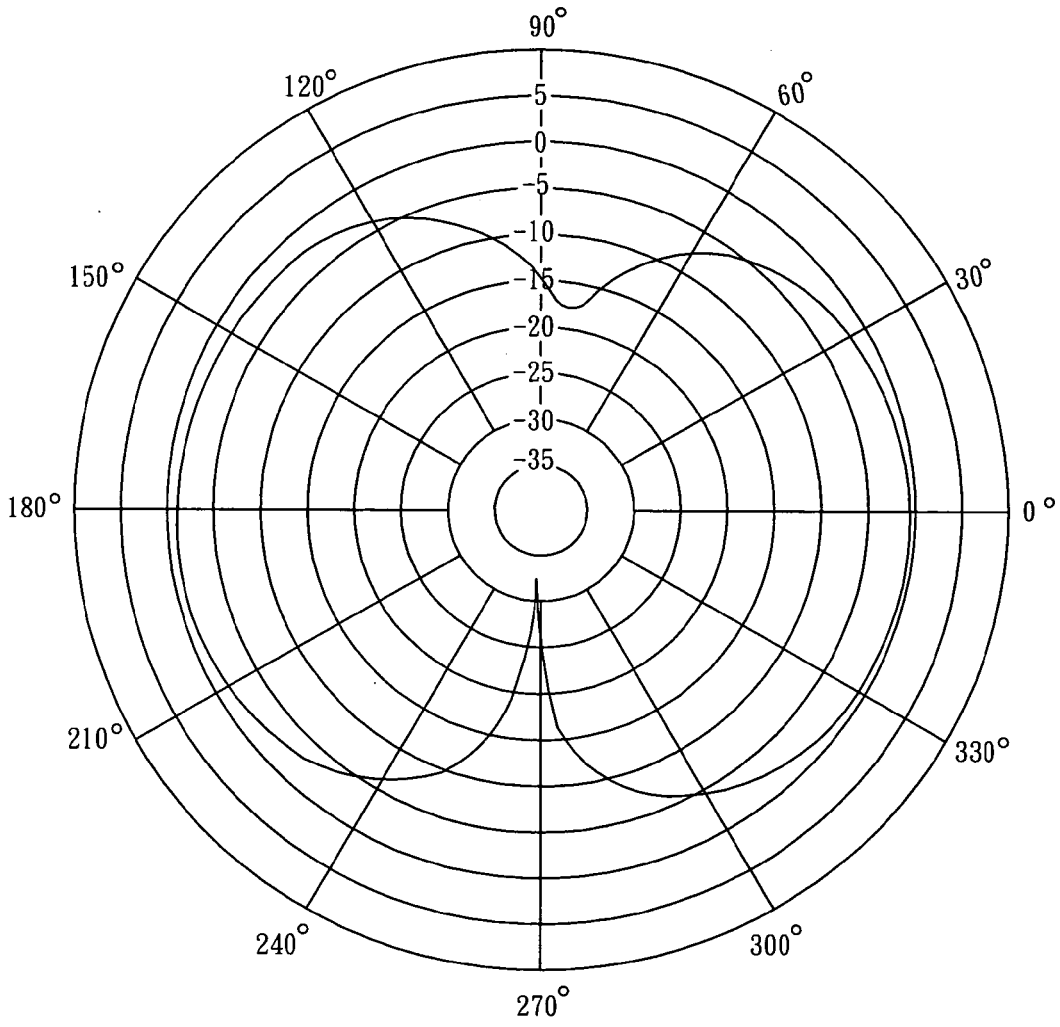
FIG. 4 is the E-plane radiation field of the horizontally disposed dual-band inverted-F antenna operating at 2.45 GHz.
Figure 5:
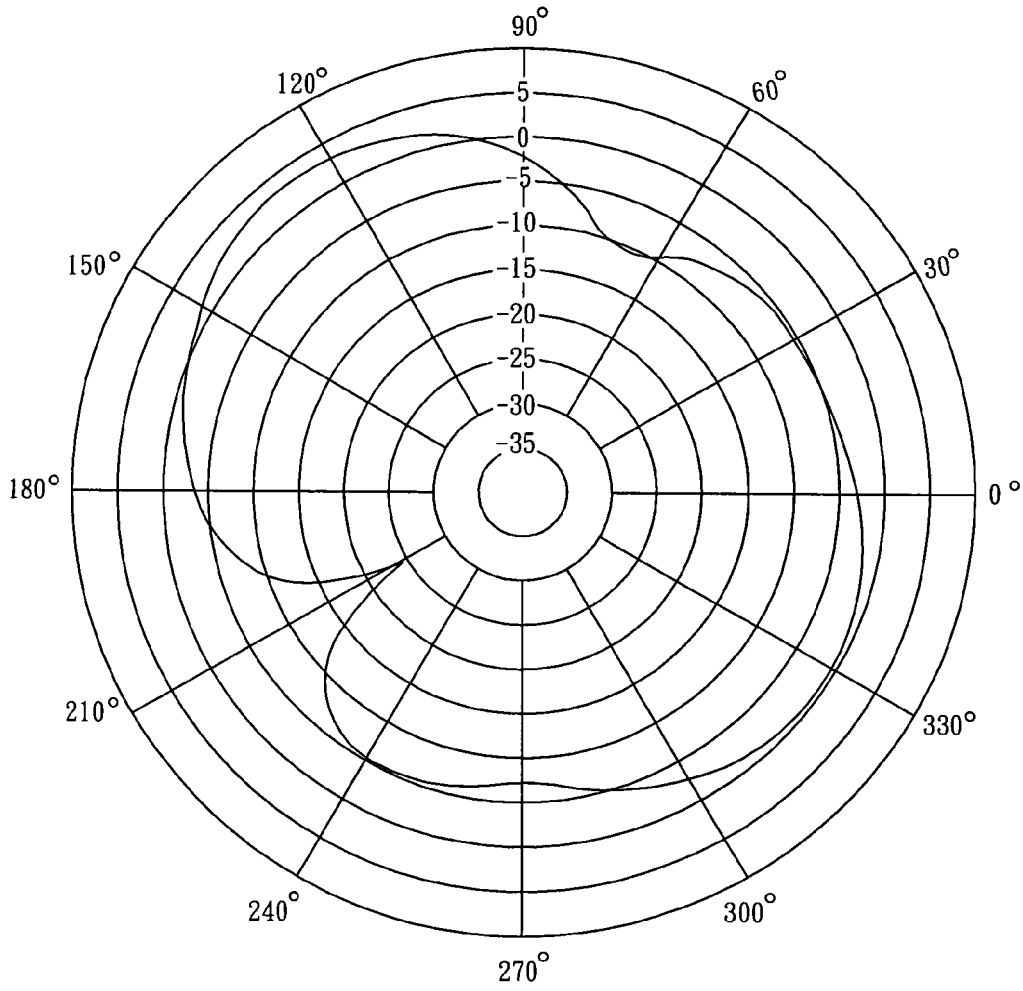
FIG. 5 is the E-plane radiation field of the horizontally disposed dual-band inverted-F antenna operating at 4.9 GHz.
Figure 6:
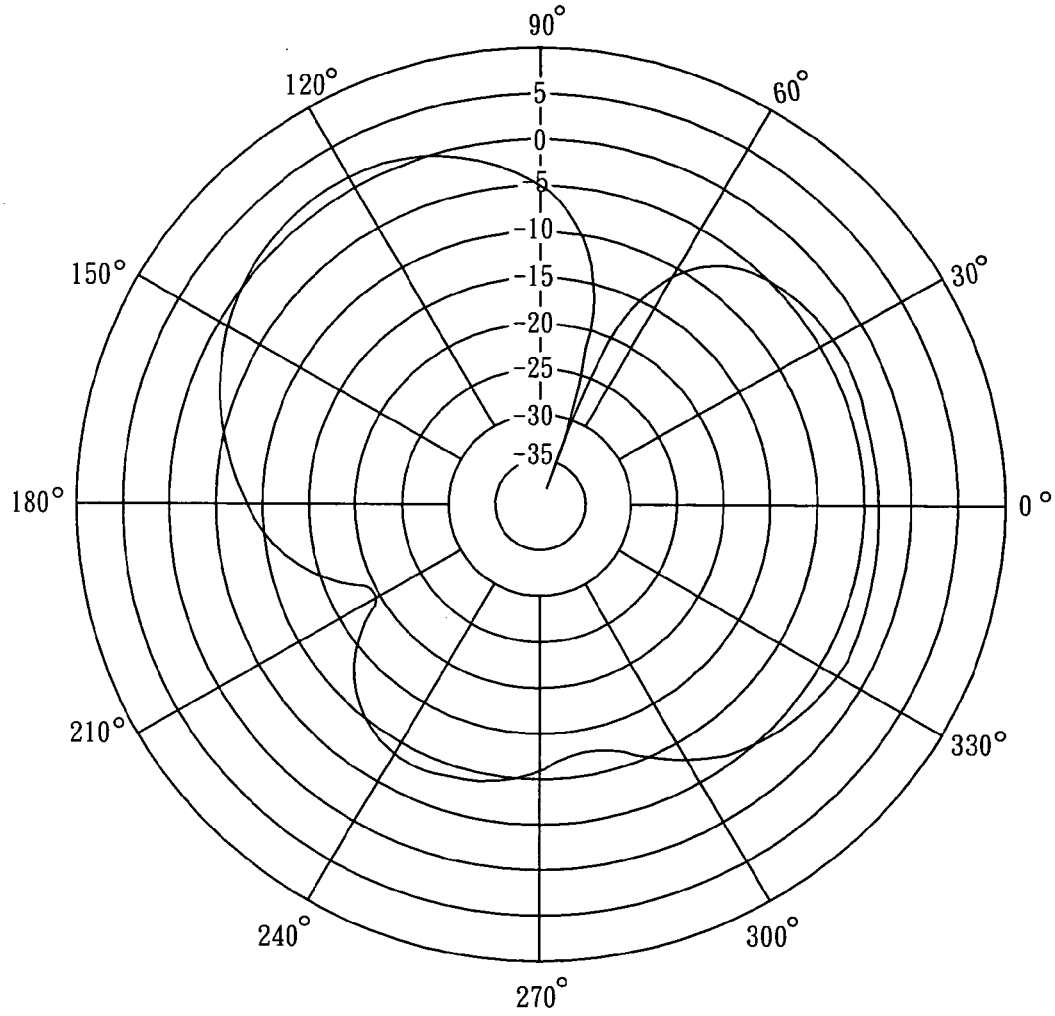
FIG. 6 is the E-plane radiation field of the horizontally disposed dual-band inverted-F antenna operating at 5.25 GHz.
Figure 7:
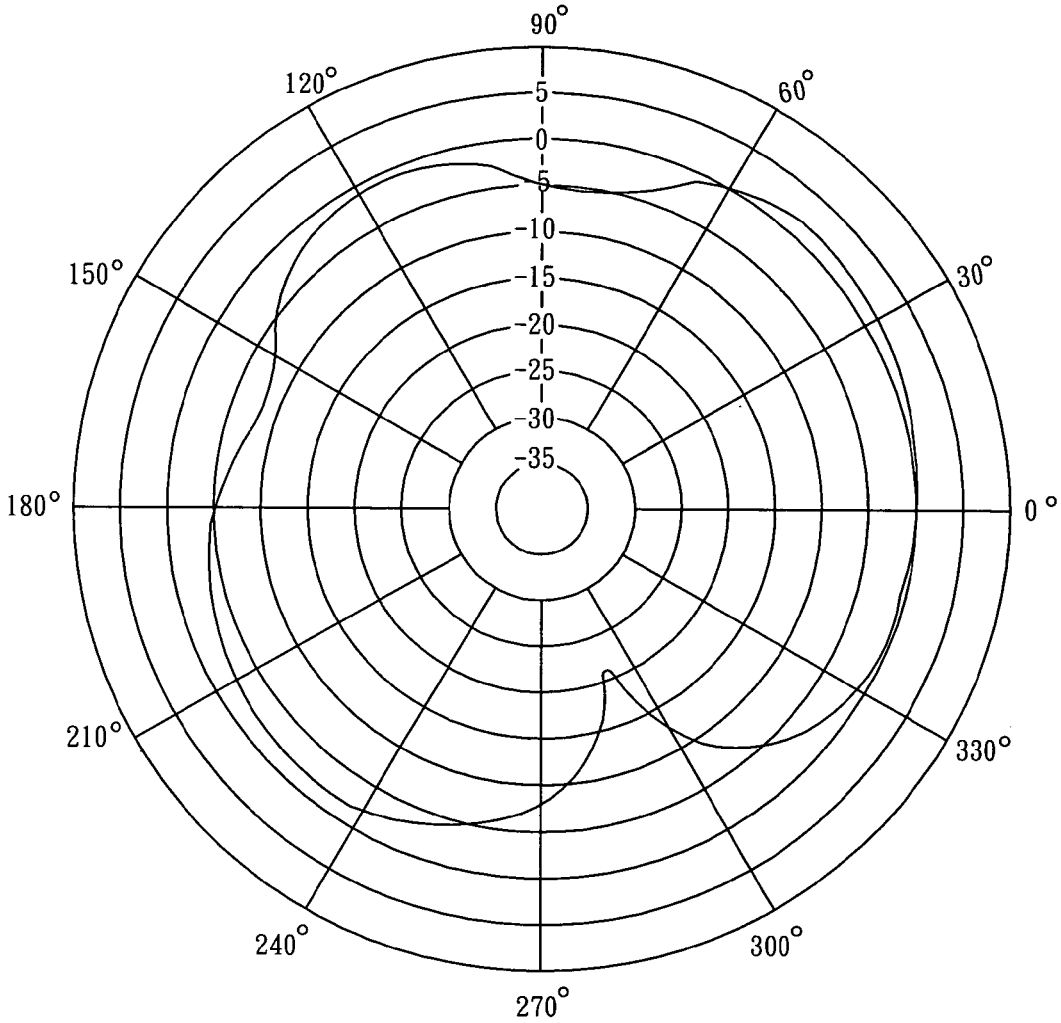
FIG. 7 is the E-plane radiation field of the horizontally disposed dual-band inverted-F antenna operating at 5.85 GHz.
Figure 8:
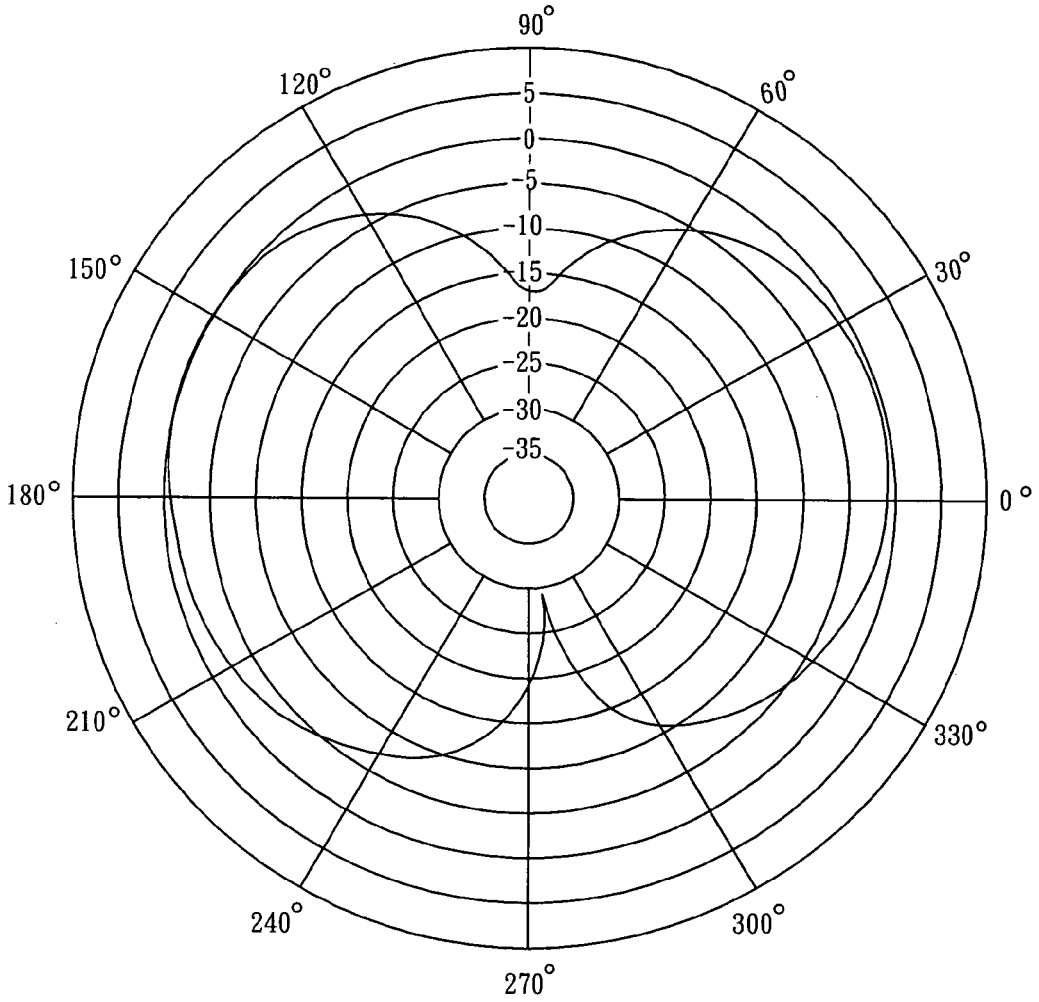
FIG. 8 is the E-plane radiation field of the vertically disposed dual-band inverted-F antenna operating at 2.45 GHz.
Figure 9:
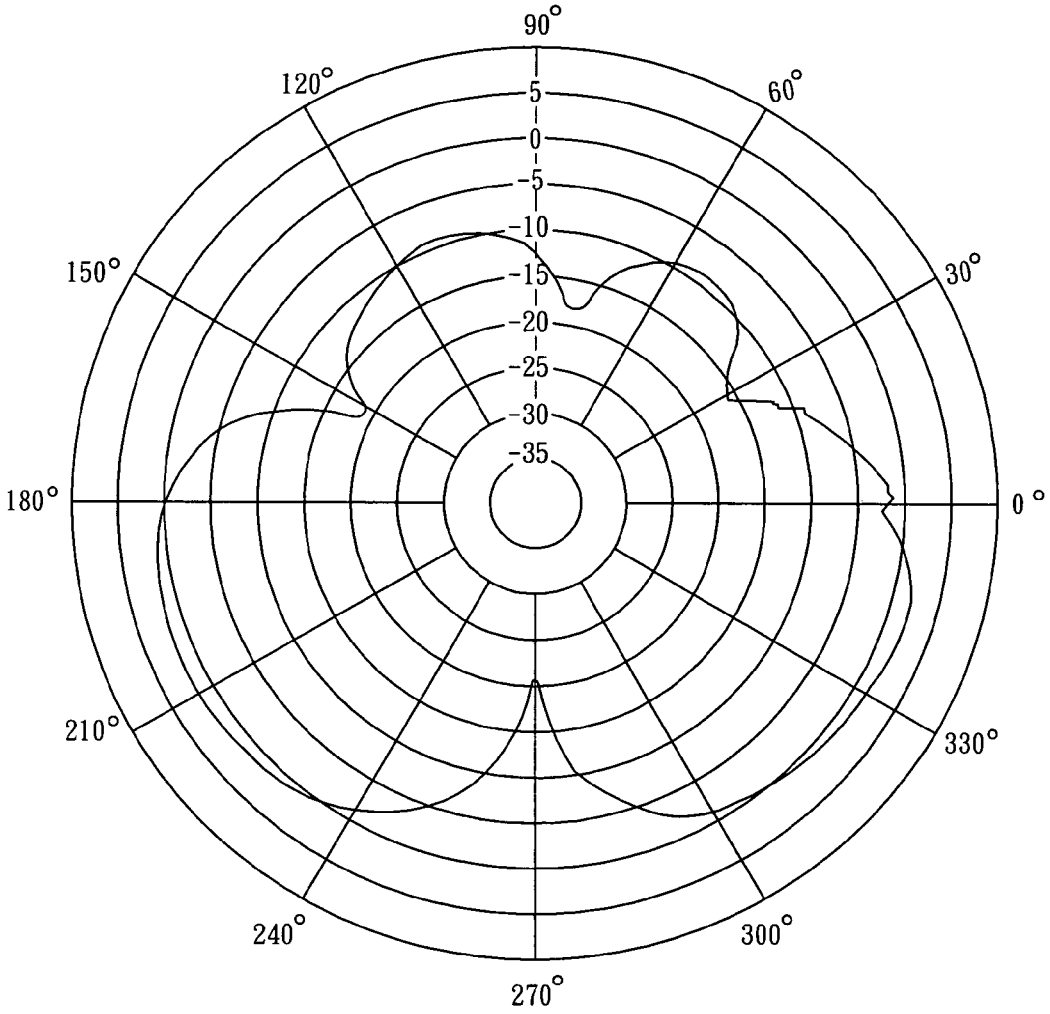
FIG. 9 is the E-plane radiation field of the vertically disposed dual-band inverted-F antenna operating at 4.9 GHz.
Figure 10:
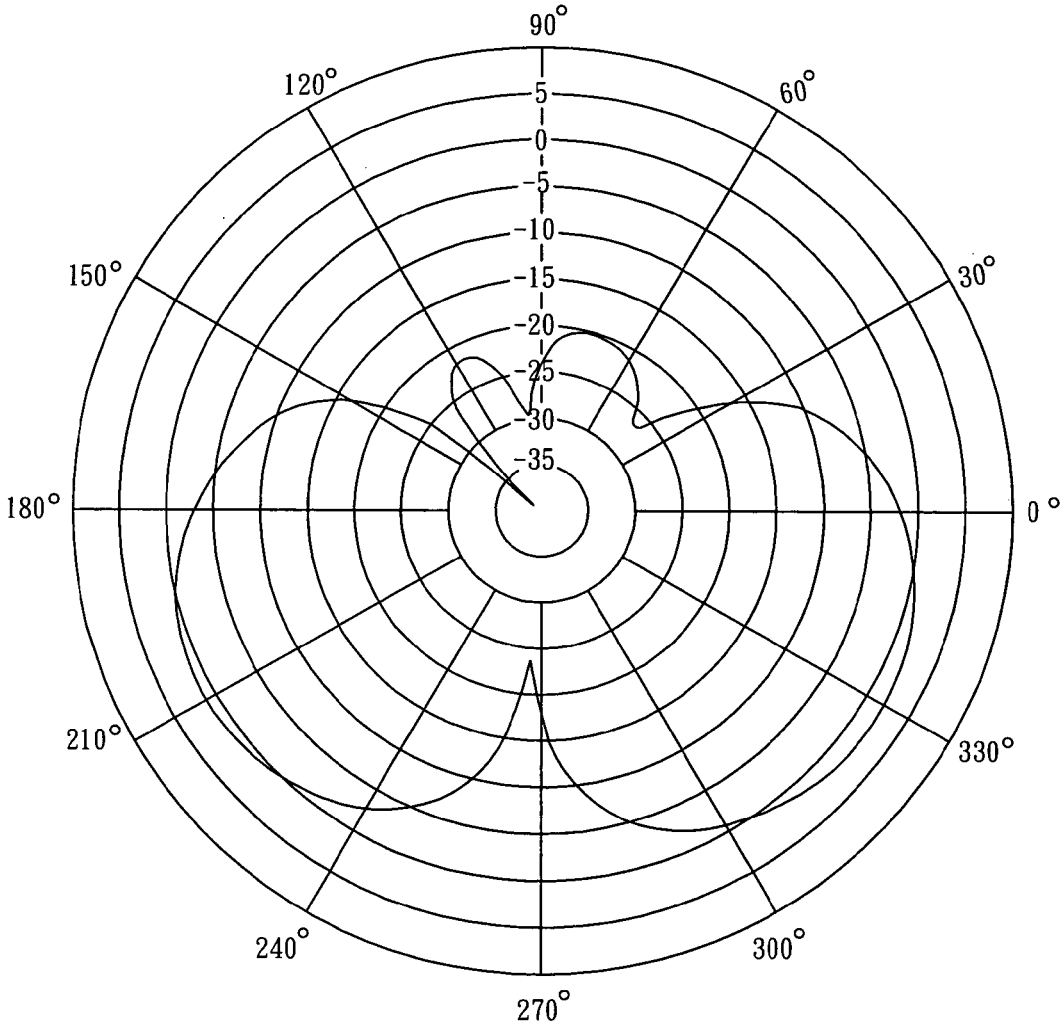
FIG. 10 is the E-plane radiation field of the vertically disposed dual-band inverted-F antenna operating at 5.25 GHz.
Figure 11:
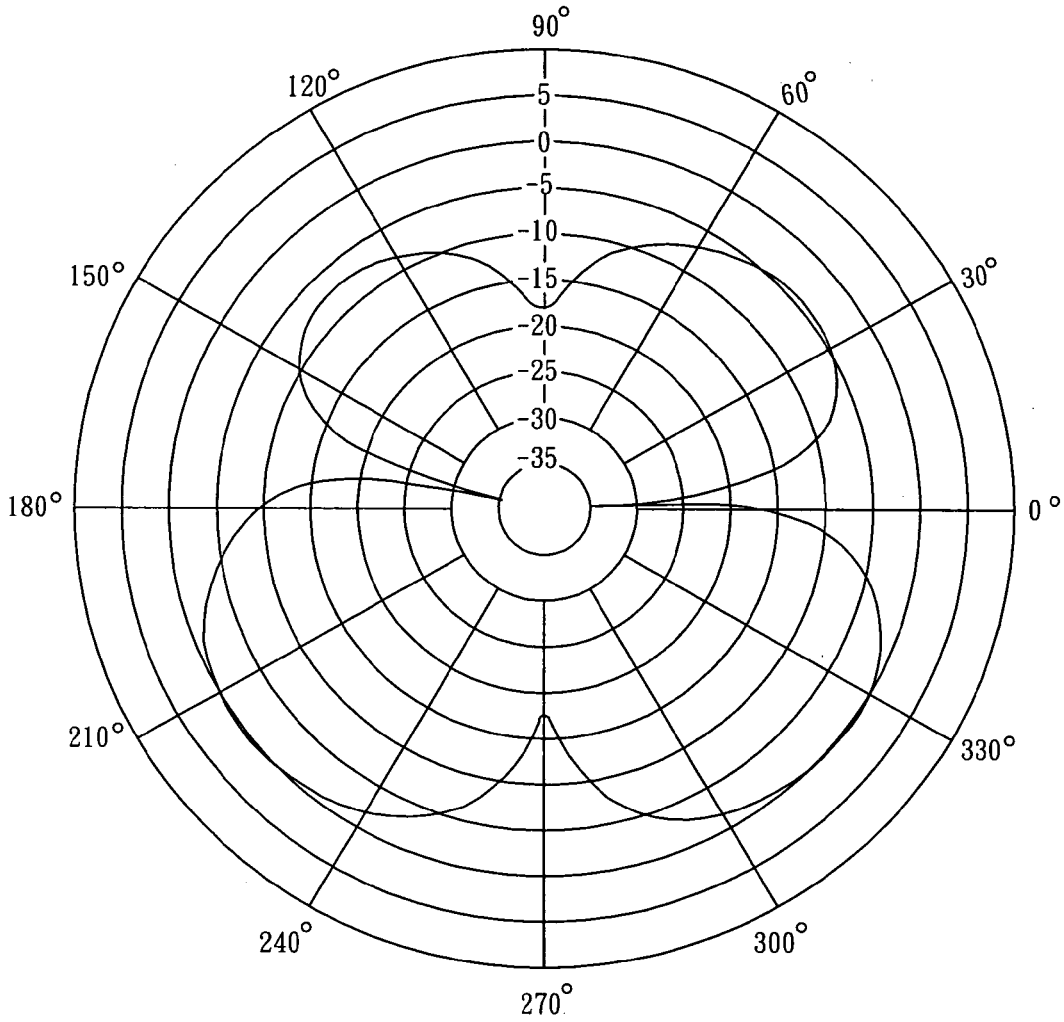

In FIG. 3, the vertical axis is the voltage-standing wave ratio (VSWR) and the horizontal axis represents the frequency. VSWR's smaller than 2 are generally acceptable by usual applications. It is observed that the disclosed dual-band inverted-F antenna 2 can operate between 2.4 GHz and 2.5 GHz and between 4.5 GHz and 5.85 GHz.

Figure 12:
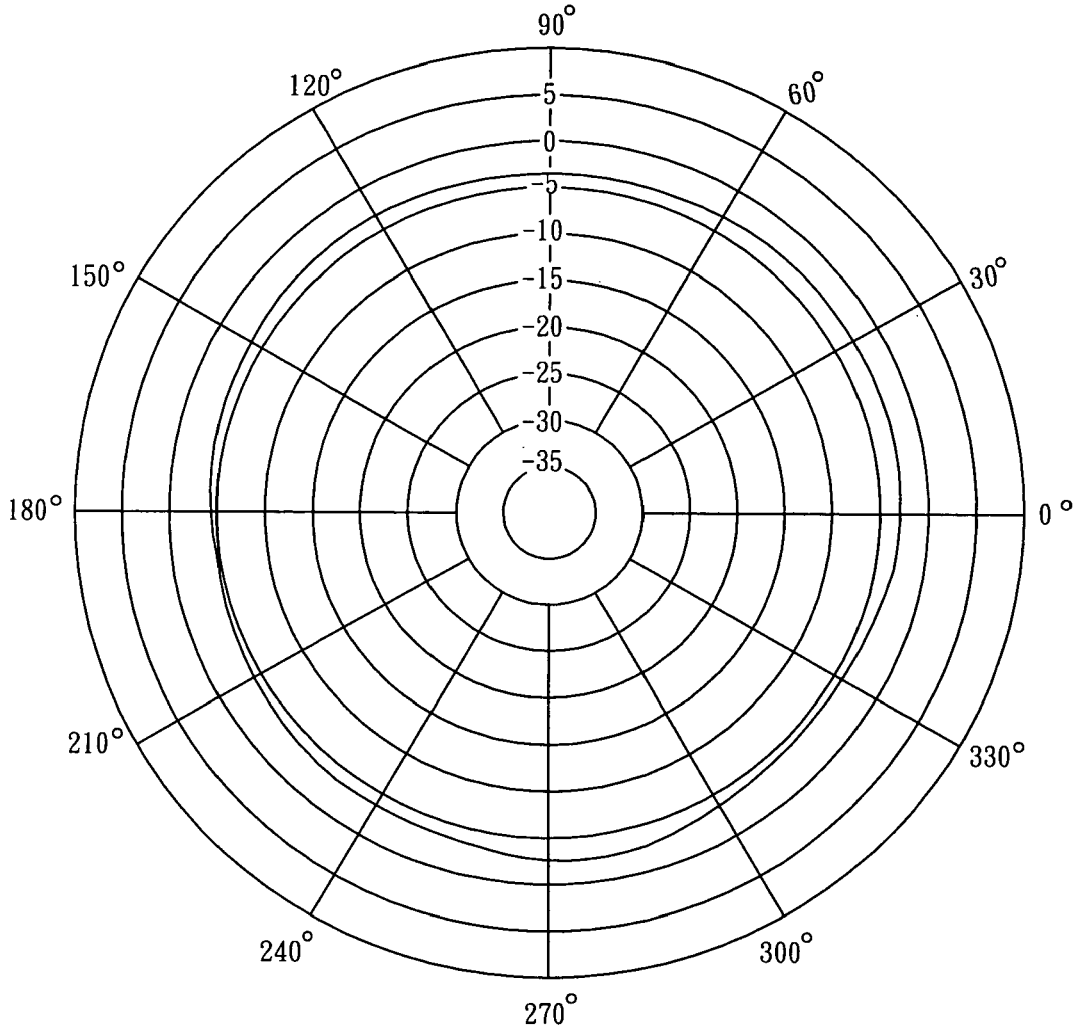
FIG. 12 is the H-plane radiation field of the dual-band inverted-F antenna operating at 2.45 GHz.
Figure 13:
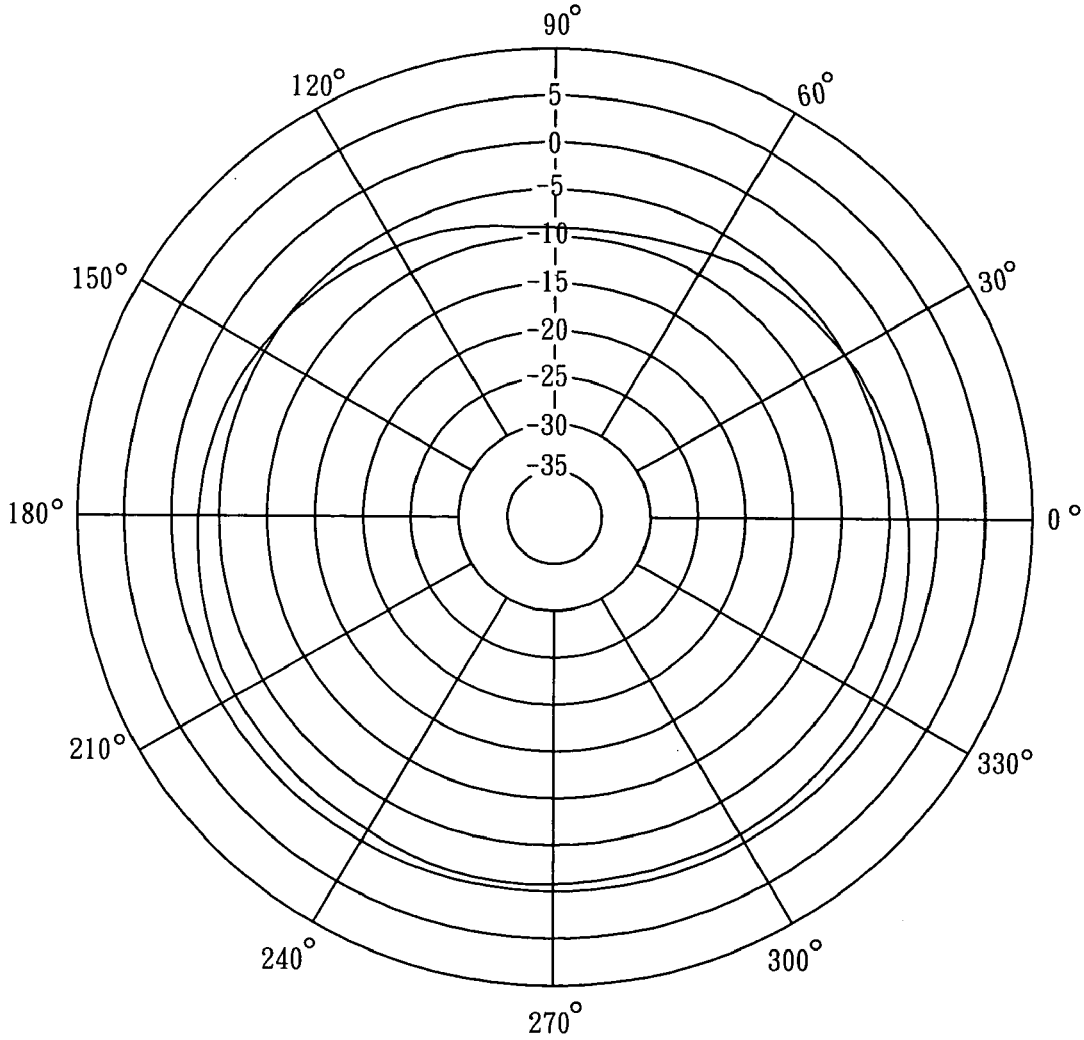
FIG. 13 is the H-plane radiation field of the dual-band inverted-F antenna operating at 5.25 GHz.
Figure 14:
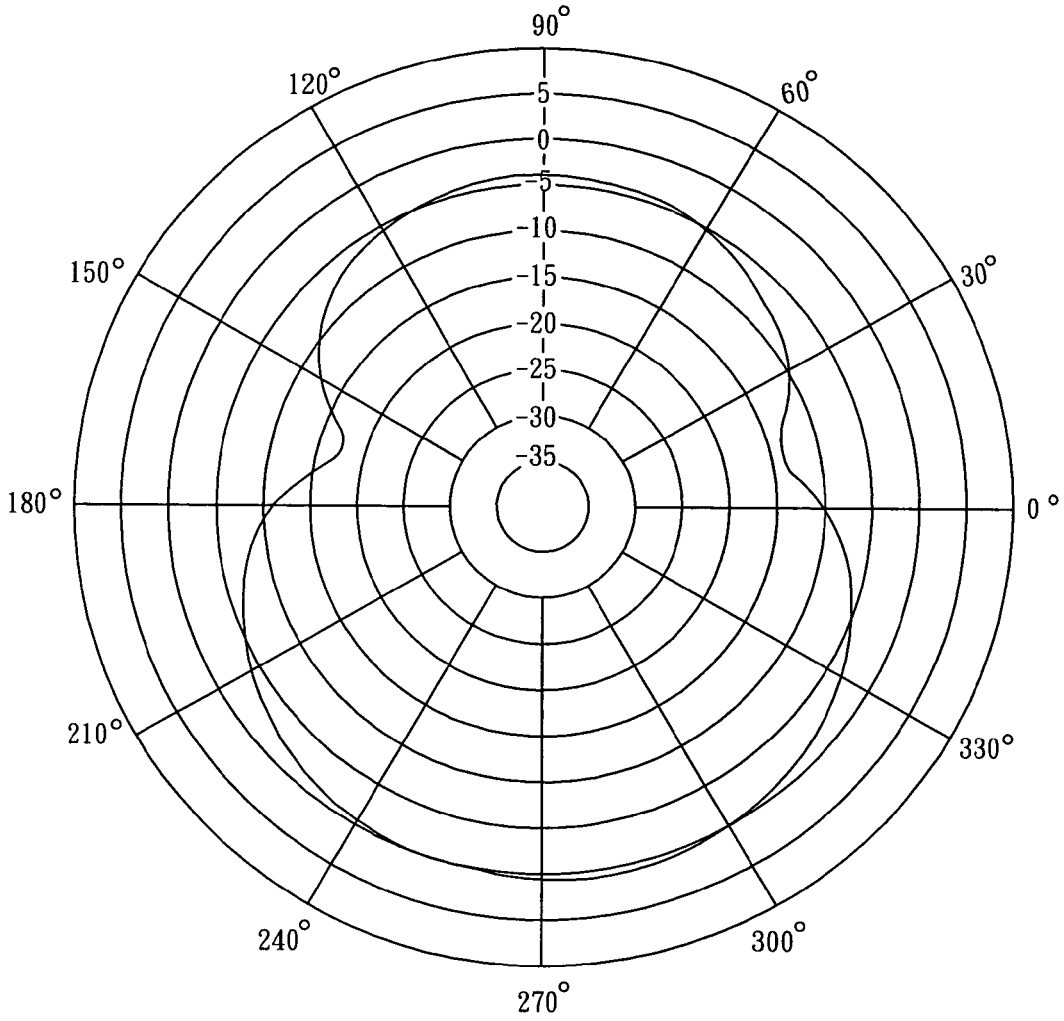
FIG. 14 is the H-plane radiation field of the dual-band inverted-F antenna operating at 5.85 GHz.

The normal antenna is designed for a radiation field with a particular orientation. Therefore, it has a better efficiency only in some particular direction. FIGS. 4 to 7 show the E-plane radiation fields of the horizontally disposed dual-band inverted-F antenna 2 according to a preferred embodiment of the invention operating at 2.45 GHz, 4.9 GHz, 5.25 GHz, and 5.85 GHz. FIGS. 8 to 11 show the E-plane radiation fields of the vertically disposed dual-band inverted-F antenna 2 operating at 2.45 GHz, 4.9 GHz, 5.25 GHz, and 5.85 GHz. FIGS. 12 to 14 show the H-plane radiation fields of the dual-band inverted-F antenna 2 operating at 2.45 GHz, 5.25 GHz, and 5.85 GHz. Observations from FIGS. 4 to 14 indicate that the disclosed dual-band inverted-F antenna 2 has three radiation fields for use.

In summary, according to the disclosed dual-band inverted-F antenna, the first radiating unit and the second radiating unit operate in the first band. The third radiating unit operates in the second band. The first band and the second band are compliant respectively with the IEEE 802.11b/g and IEEE 802.11a standards. Moreover, the disclosed dual-band inverted-F antenna uses an impedance matching unit to increase the bandwidths. Therefore, it can satisfy the modern bandwidth requirements and have two operating bands. Besides, the disclosed dual-band inverted-F antenna has better radiation fields than the prior art whether it is disposed vertically and horizontally.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A dual-band inverted-F antenna, comprising:

a first radiating unit having a first long side and a first short side;

a second radiating unit having a second long side and a second short side, wherein the second long side is disposed opposite to the first short side of the first radiating unit; and a third radiating unit having a first radiating part, a second radiating part, and a third radiating part, wherein the second radiating part and the third radiating part are extended respectively from one side of the first radiating part, and a gap exists between the third radiating unit and the first radiating unit.

2. The dual-band inverted-F antenna of claim 1, wherein the first radiating unit and the second radiating unit operate in a first band.

3. The dual-band inverted-F antenna of claim 2, wherein the first band is compliant with the IEEE 802.11b/g standard between 2.4 GHz and 2.5 GHz.

4. The dual-band inverted-F antenna of claim 2, wherein a length of the first long side and a length of the second long side are roughly equal to one quarter of the wavelengths in the first band.

5. The dual-band inverted-F antenna of claim 1, wherein the third radiating unit operates in a second band.

6. The dual-band inverted-F antenna of claim 5, wherein the second band is compliant with the IEEE 802.11a standard between 4.5 GHz and 5.85 GHz.

7. The dual-band inverted-F antenna of claim 1, wherein the first radiating part, the second radiating part, and the third radiating part of the third radiating unit are quadrangles.

8. The dual-band inverted-F antenna of claim 5, wherein, in the third radiating unit, the first radiating part, the second radiating part, and the third radiating part are trapezoids, the lower bases of the second radiating part and the third radiating part are part of the upper base of the first radiating part, and the second and third radiating parts are extended from the upper base of the first radiating part.

9. The dual-band inverted-F antenna of claim 8, wherein the sum of lengths of the upper bases of the second radiating part and the third radiating part is greater than or equal to one third of a length of the lower base of the first radiating part.

10. The dual-band inverted-F antenna of claim 8, wherein a length of the upper base of the second radiating part is greater than a length of the upper base of the third radiating part.

11. The dual-band inverted-F antenna of claim 8, wherein a length of the lower base of the first radiating part is about one quarter of the wavelengths in the second band.

12. The dual-band inverted-F antenna of claim 1 further comprising an impedance matching unit, wherein one side of the impedance matching unit is disposed opposite to the third radiating unit, and another side of the impedance matching unit is disposed opposite to the first radiating unit.

13. The dual-band inverted-F antenna of claim 12, wherein the impedance matching unit is a polygonal.

14. The dual-band inverted-F antenna of claim 1 further comprising a substrate, wherein the first radiating unit, the second radiating unit, and the third radiating unit are disposed on the substrate.

15. The dual-band inverted-F antenna of claim 14, wherein the substrate is a print circuit board (PCB).

16. The dual-band inverted-F antenna of claim 1, wherein the gap has an L shape.

17. The dual-band inverted-F antenna of claim 1, wherein the first radiating unit and the second radiating unit have respectively a feed-in point and a ground point.

18. The dual-band inverted-F antenna of claim 17 further comprising a conducting unit, wherein the conducting unit has a conductor in electrical contact with the feed-in point and a ground conductor in electrical contact with the ground point.

19. The dual-band inverted-F antenna of claim 18, wherein the conducting unit is a coaxial cable.

* * * * *